US007462072B2

(12) United States Patent
Anderson et al.

(10) Patent No.: US 7,462,072 B2
(45) **Date of Patent: *Dec. 9, 2008**

(54) APPARATUS FOR ASSOCIATING A CABLE WITH AN ELECTRONIC DEVICE AND IMPROVING ELECTROMAGNETIC COMPATABILITY SHIELDING BETWEEN THE CABLE AND THE ELECTRONIC DEVICE

(75) Inventors: Lynda L. Anderson, Saugerties, NY (US); Norman L. Hoffman, Poughkeepsie, NY (US); Robert E. Mahoney, Poughkeepsie, NY (US); Robert L. Nicoletti, Milton, NY (US); Andrew Rybak, Hopewell Junction, NY (US); Kenneth A. Scea, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/025,855

(22) Filed: Feb. 5, 2008

(65) Prior Publication Data

US 2008/0146081 A1 Jun. 19, 2008

Related U.S. Application Data

(63) Continuation of application No. 11/468,006, filed on Aug. 29, 2006, now Pat. No. 7,377,811.

(51) Int. Cl.
*H01R 9/03* (2006.01)

(52) U.S. Cl. ..... 439/610; 439/98

(58) Field of Classification Search ..... 439/98, 439/578, 585, 610

See application file for complete search history.

(56) References Cited

U.S. PATENT DOCUMENTS

| | | | | |
|---|---|---|---|---|
| 4,290,663 | A | 9/1981 | Fowler et al. | |
| 4,854,891 | A | 8/1989 | Kamei et al. | |
| 5,046,964 | A | 9/1991 | Welsh et al. | |
| 5,052,947 | A | 10/1991 | Brodie et al. | |
| 5,055,070 | A | 10/1991 | Plegge et al. | |
| 5,180,316 | A | 1/1993 | Miller et al. | |
| 6,012,950 | A * | 1/2000 | Vanbesien | 439/610 |
| 6,336,827 | B1 | 1/2002 | Akama et al. | |
| 6,530,789 | B2 * | 3/2003 | Konda | 439/98 |
| 6,554,644 | B2 | 4/2003 | Koide | |
| 6,846,201 | B2 | 1/2005 | Lazaro, Jr. | |
| 6,929,512 | B2 | 8/2005 | Lai | |
| 7,094,103 | B2 | 8/2006 | Lai | |
| 2002/0102872 | A1 | 8/2002 | Kanagawa | |
| 2002/0173181 | A1 | 11/2002 | Matsumoto | |
| 2005/0170696 | A1 | 8/2005 | Matsuoka | |

FOREIGN PATENT DOCUMENTS

| | | | |
|---|---|---|---|
| JP | 2004153905 | A | 5/2004 |
| JP | 2004153904 | A | 6/2004 |

* cited by examiner

*Primary Examiner*—Thanh-Tam T Le
(74) *Attorney, Agent, or Firm*—Cantor Colburn LLP; Lily Neff

(57) ABSTRACT

Disclosed is an apparatus for associating a cable including a braid with an electronic device and improving electromagnetic compatibility (EMC) shielding between the cable and the electronic device, the apparatus including a tubular member including an outer dimension, and defining a first opening, a second opening, and a cable cavity, the tubular member being configured to associate with the electronic device and the braid of the cable, the outer dimension of the tubular member being further configured to receive a charge from the braid of the cable in a region of the tubular member disposed externally to the electronic device.

8 Claims, 5 Drawing Sheets

APPARATUS FOR ASSOCIATING A CABLE WITH AN ELECTRONIC DEVICE AND IMPROVING ELECTROMAGNETIC COMPATABILITY SHIELDING BETWEEN THE CABLE AND THE ELECTRONIC DEVICE

CROSS REFERENCE TO RELATED APPLICATION

This application is a Continuation application of U.S. Ser. No. 11/468,006, filed Aug. 29, 2006, the contents of which are incorporated by reference herein in their entirety.

BACKGROUND OF THE INVENTION

1. Field of the Invention

The disclosure relates generally to a method and apparatus for associating a cable with an electronic device, and more particularly to a method and apparatus for associating a cable with an electronic device and improving electromagnetic compatibility (EMC) shielding between the cable and the electronic device.

2. Description of Background

As data rates for cable assemblies increase, better electromagnetic compatibility (EMC) shielding between cable assemblies and electronic devices has become desirable. EMC is the measure of unintentional generation, propagation and reception of electromagnetic energy, and the unwanted effects that such an energy may induce in an electronic component environment. Current methods for improving EMC performance and shielding include cable clamping, cable braid distribution, and use of conductive foams. These methods have offered only marginal improvements, and can be difficult to implement.

For example, assembly operations on cables that are to be clamped require that a jacket of the cable be "milked back" in the early stages of cable build. "Milking back" the jacket is a labor-intensive process that requires the operator to manually pull the jacket back thereby exposing a braid. After pulling back the jacket to expose the braid the collapsed area of the jacket is taped to secure it. Subsequently at final assembly of the cable, the jacket is manually pulled back up allowing the back shell to be clamped onto the jacket. This operation is a very difficult, time consuming, and manual process, that is compounded by jacket stiffness, which may vary by bulk cable supplier. With some cable assemblies now requiring plenum rated bulk cable, which includes a very stiff jacket, the current assembly operations requiring jacket "milking" actually cannot be incorporated into assembly. As such, more convenient assembly operations, which eliminate the need for jacket "milking," and improved EMC shielding, are both desirable.

SUMMARY OF THE INVENTION

Disclosed is an apparatus for associating a cable including a braid with an electronic device and improving electromagnetic compatibility (EMC) shielding between the cable and the electronic device, the apparatus including a tubular member including an outer dimension, and defining a first opening, a second opening, and a cable cavity, the tubular member being configured to associate with the electronic device and the braid of the cable, the outer dimension of the tubular member being further configured to receive a charge from the braid of the cable in a region of the tubular member disposed externally to the electronic device.

Also disclosed is A method for associating a cable including a braid with an electronic device and improving electromagnetic compatibility (EMC) shielding between the cable and the electronic device, the method including disposing a tubular member including an outer dimension and defining a first opening, a second opening, and a cable cavity into a device cavity defined by the electronic device, and associating the braid of the cable with the outer dimension of the tubular member in a region of the tubular member disposed externally to the electronic device.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Figure 1:
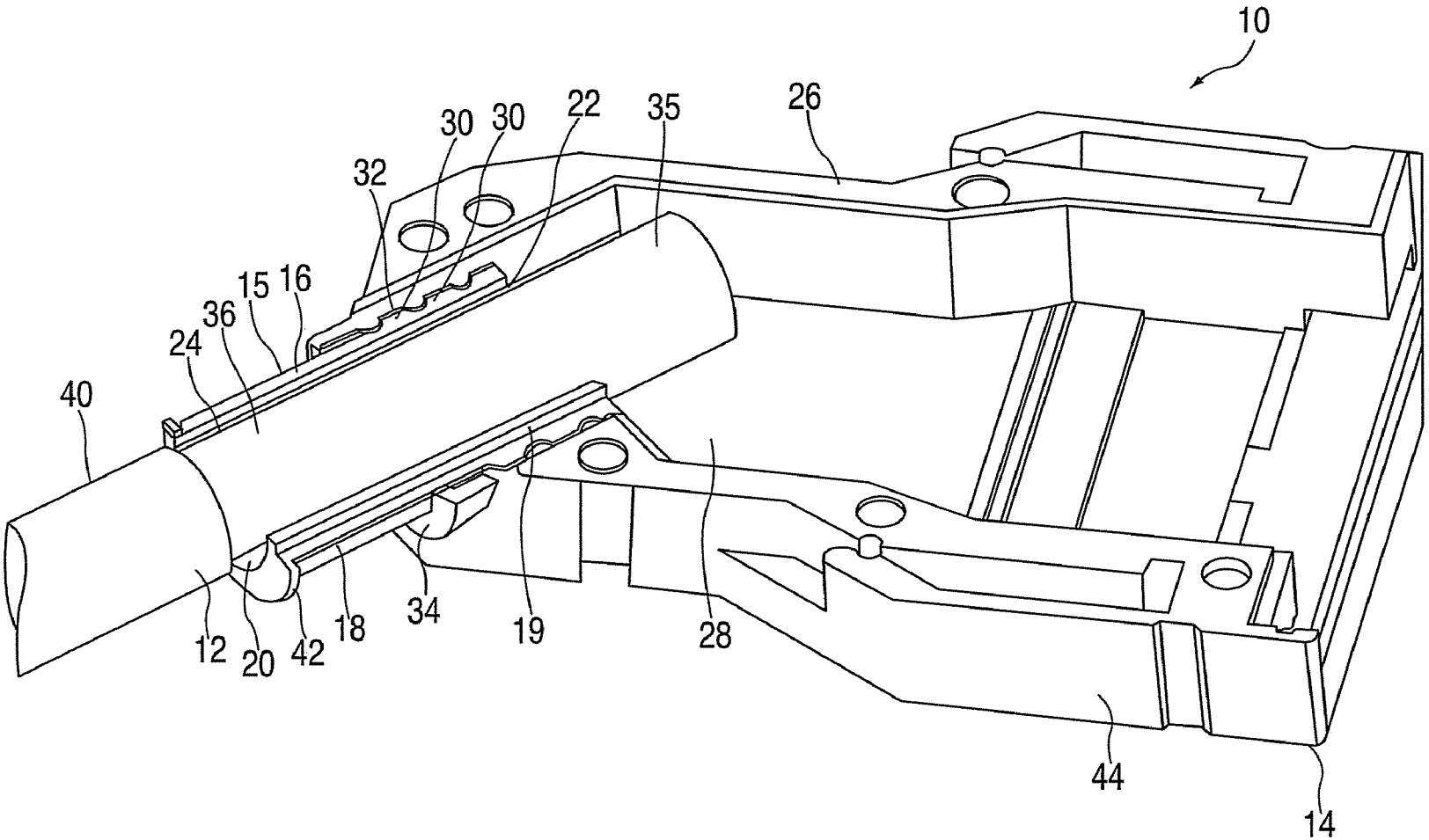
FIG. 1 is a schematic cross-section of an apparatus for associating a cable with an electronic device and improving electromagnetic compatibility (EMC) shielding between the cable and electronic device from a side perspective view.
Figure 2:
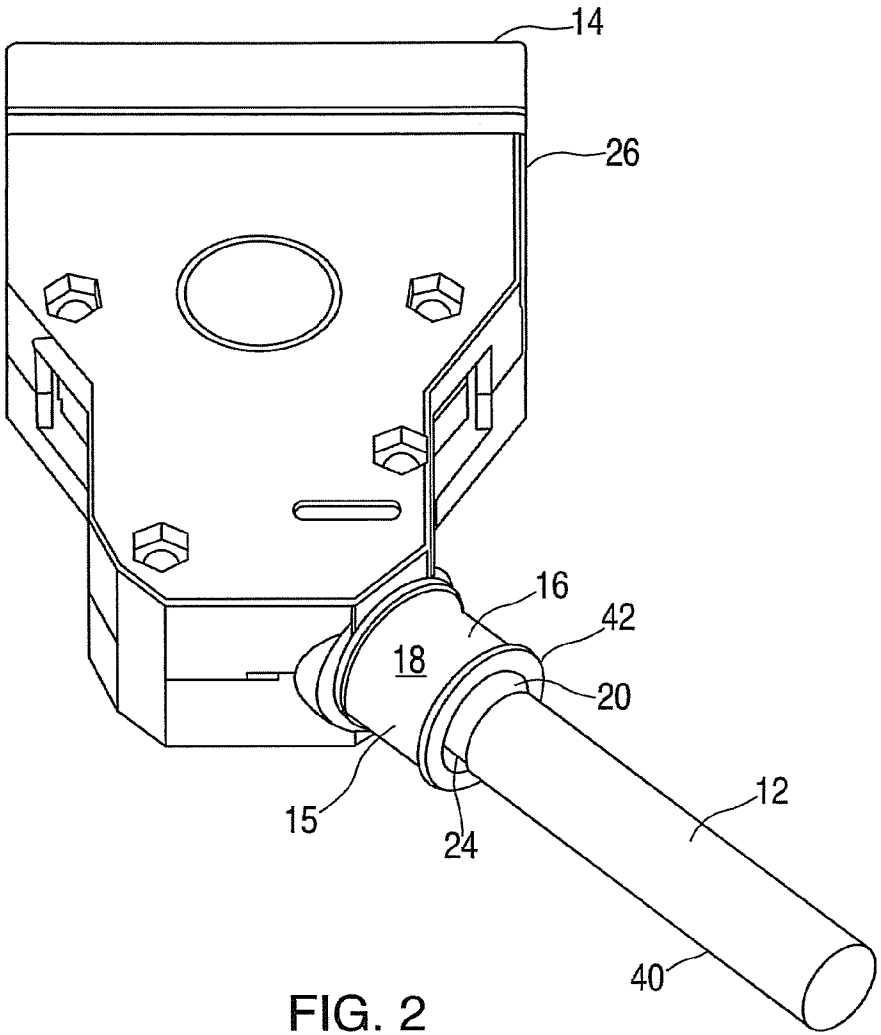
FIG. 2 is a schematic of the apparatus for associating a cable with an electronic device and improving EMC shielding between the cable and electronic device from a side perspective view.
Figure 3:
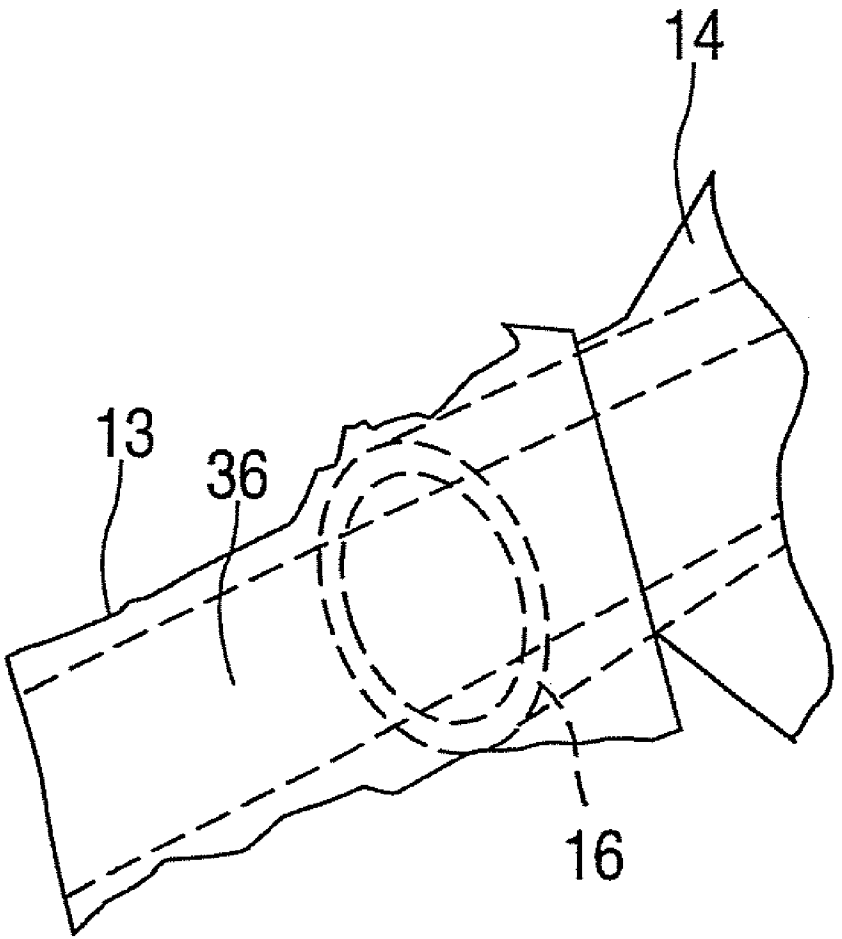
FIG. 3 is a schematic of the apparatus for associating a cable with an electronic device and improving EMC shielding between the cable and electronic device from a side perspective view, illustrating a braid of the cable.

Referring to FIGS. 1-4, an apparatus 10 for associating a cable 12 including a braid 13 with an electronic device 14 and improving electromagnetic compatibility (EMC) shielding between the cable 12 and electronic device 14 is illustrated. The apparatus 10 comprises a tubular member 16 that includes an outer dimension 18, and defines a first opening 20, a second opening 22, and a cable cavity 24. The tubular member 16 is configured to associate with the electronic device 14 and the braid 13 of the cable 12 in a manner that allows the outer dimension 18 of the tubular member 16 to receive a charge from the braid 13 of the cable 12 in a region 15 of the tubular member 16 disposed externally to the electronic device 14. It should be appreciated that the tubular member 16 may include any geometric cross-section.

In an exemplary embodiment, such as that which is illustrated in the Figures, the tubular member 16 associates the cable 12 with a backshell portion 26 of the electronic device 14. This is accomplished by installing at least a portion, or region 19, of the tubular member 16 into a device cavity 28 defined by the backshell 26. This region 19 of the tubular member 16 includes the second opening 22, which opens into the device cavity 28. The outer dimension 18 of this region 19 may further define at least one ridge 30 that is associable with at least one groove 32 defined by the backshell 26, and located within the device cavity 28. Association of the ridges 30 with the grooves 32 provides a secure association between the tubular member 16 and the backshell 26 (and thus, the electronic device 14). This type of secure association may also be accomplished via a lip (not illustrated) extending from an end of the tubular member 16 and associating with a flange structure (not illustrated) defined by the backshell 26 and located within the device cavity 28.

The region 15 of the tubular member 16 not disposed in the device cavity 28 of the backshell 26 (i.e. external to the electronic device 14) may extend from the backshell 26 into a surrounding environment via a device opening 34 defined by the backshell 26. This region 15 includes the first opening 20. In the embodiment shown in the Figures, an end 35 of the cable 12 may enter the cable cavity 24 via the first opening 20, and extend through the cable cavity 24 from the first opening 20, through the second opening 22, and into the device cavity 28. It should be appreciated that an electronic device 14 that does not include the backshell 26 described in this embodiment may itself define the device cavity 28 and device opening 34 in any portion of its (the electronic device's) structure. As such, the tubular member 16 and cable 12 may be disposed in and extend from the device cavity 28 and device opening 34 of any portion of the electronic device 14, just as is discussed above with regards to the backshell 26.

Figure 4:
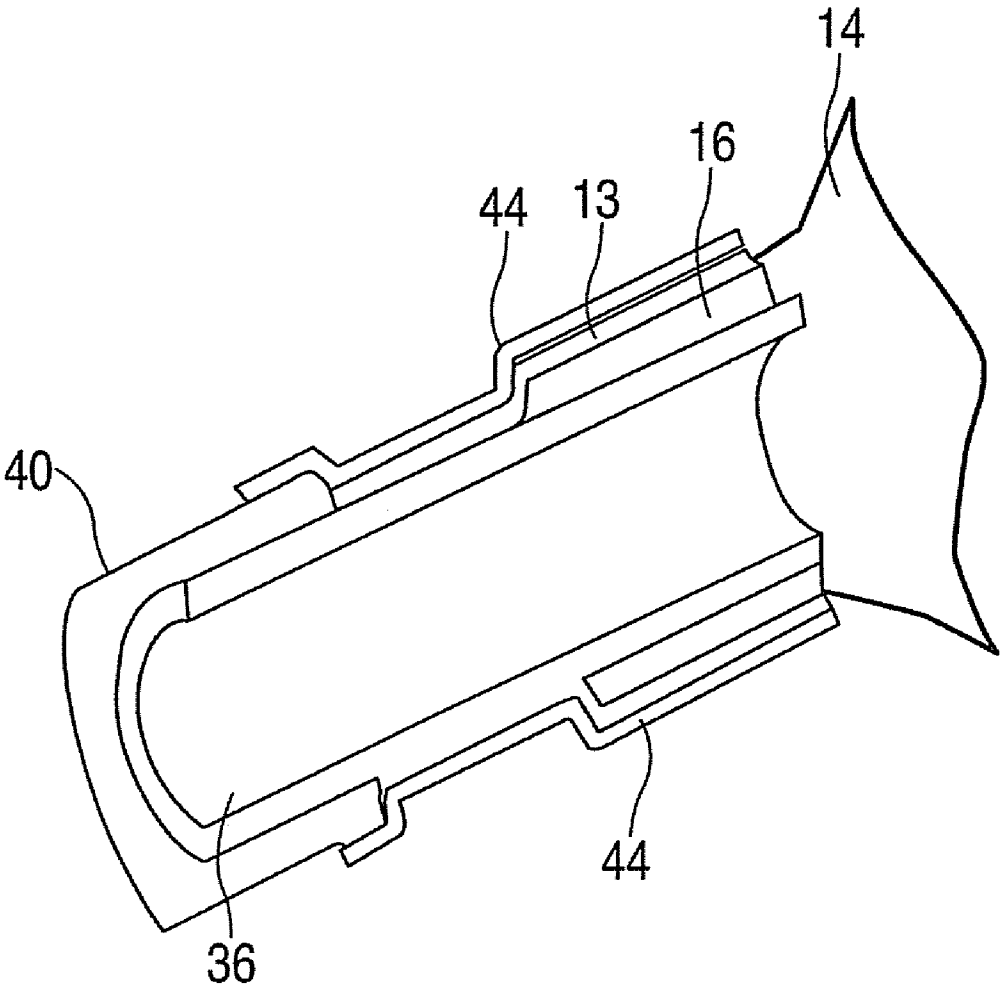
FIG. 4 is a schematic cross-section of the apparatus for associating a cable with an electronic device and improving EMC shielding between the cable and electronic device from a side perspective view, illustrating the braid of the cable and a PVC adhesive.

Referring again to the exemplary embodiment discussed above, the cable 12 includes a conductor portion (not illustrated), a foil portion 36, the braid portion 13, and a jacket portion 40. The foil 36 of the cable is a shielding material that houses and separates the conductor from the metallic mesh braid 13, which in turn is housed and shielded from the external environment by the jacket 40 In this embodiment, the foil portion 36 of the end 35 of the cable 12, and any cable components contained internally to the foil portion 36 (such as the conductor), are the portions of the cable 12 that are disposed within the cable cavity 24. The braid portion 13 and jacket portion 40 are the portions disposed externally to the cable cavity 24. The jacket portion 40 is cut off short of the first opening 20, exposing the woven metal braid portion 13. The exposed braid portion 13 is extended over a lip 42 of the tubular member 16 so that the exposed braid 13 envelops (at 360 degrees) the portion of the tubular member 16 that extends from the backshell 26. In this manner, the cable 12 is securely associated with the tubular member 16. As shown in FIG. 4, a PVC adhesive 44, such as shrink tubing may then be applied to the exposed braid 13, further securing the cable 12 to the tubular member 16 and providing a safety measure to those who would be handling the cable. By disposing the foil portion 36 of the cable 12 in the cable cavity 24 and enveloping the region 15 of the tubular member 16 that extends from the backshell 26 with the braid portion 13, the cable 12 is associated with the electronic device 14 (backshell 26) via the tubular member 16. This eliminates the need for a "milking back" of the jacket 40 necessary for clamping/associating the jacket 40 with the backshell 26.

In addition a Faraday cage may be created around the cable cavity 24 via the enveloping of the region 15 by the woven metallic braid 13. A Faraday cage is an apparatus designed to prevent the passage of electromagnetic waves into its interior space. A charge on a surface of a Faraday conductor resides only on the surface, and has no influence on anything enclosed within. Thus, charge or EMI traveling from the braid 13 to the region 15 of the tubular member 16 will not penetrate into the cable cavity 24. As the EMI will not penetrate the cable cavity 24, it cannot affect contents of the cable cavity 24, such as the foil 36 and conductor residing therein. In this manner, effective EMC shielding between the backshell 26 and cable 12 is achieved.

Figure 5:
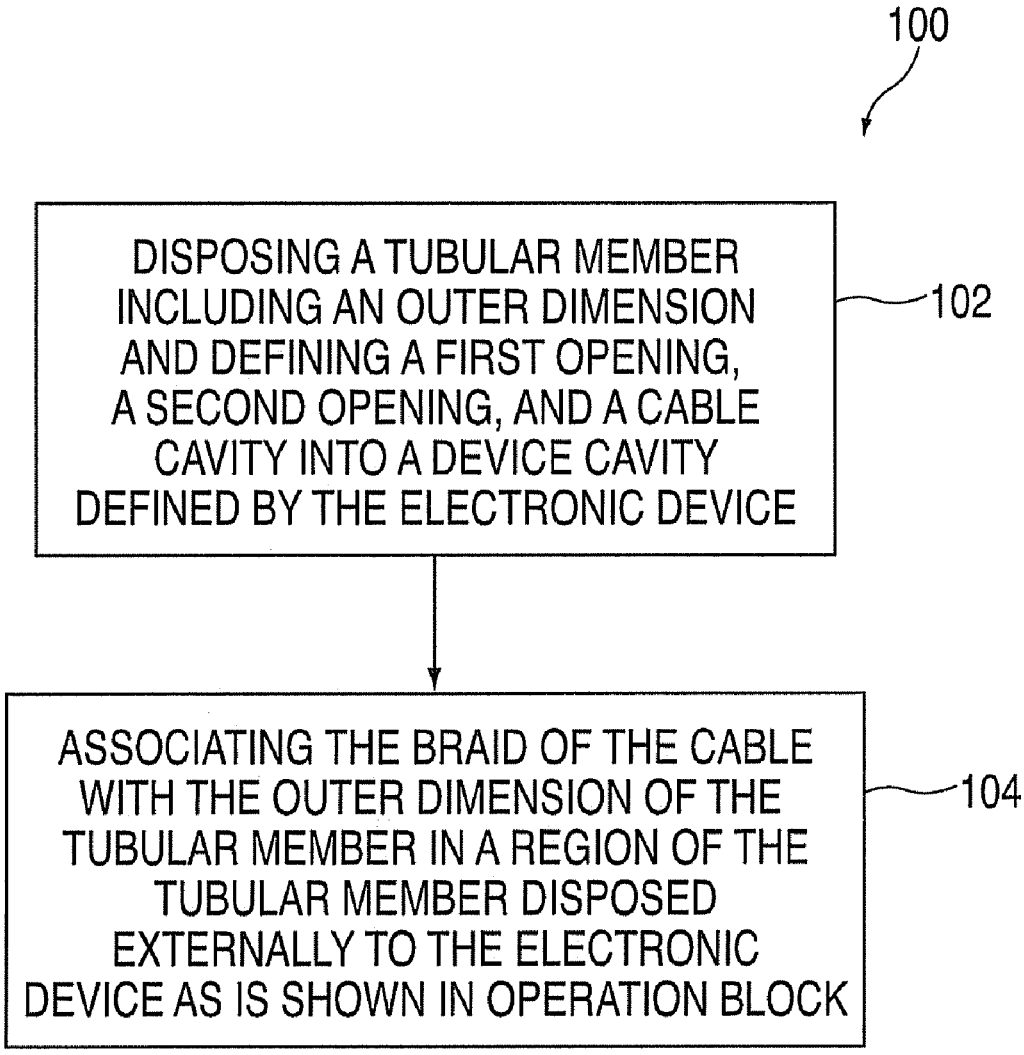
FIG. 5 is a block diagram illustrating a method for associating a cable with an electronic device and improving EMC shielding between the cable and electronic device.

Referring to FIG. 5, a method 100 for associating a cable 12 including a braid with an electronic device 14 and improving electromagnetic compatibility (EMC) shielding is illustrated and includes disposing a tubular member 16 including an outer dimension 18 and defining a first opening 20, a second opening 22, and a cable cavity 24 into a device cavity defined by the electronic device 14, as shown in operational block 102. The method 100 also includes associating the braid 13 of the cable with the outer dimension 18 of the tubular member 16 in a region 15 of the tubular member 16 disposed externally to the electronic device 14, as is shown in operation block 104.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. An apparatus for associating a cable including a braid with an electronic device and improving electromagnetic compatibility (EMC) shielding between the cable and the electronic device, the apparatus comprising:

a tubular member including an outer dimension, and defining a first opening, a second opening, and a cable cavity, said tubular member being configured to associate with the electronic device and the braid of the cable, said outer dimension of said tubular member being configured to receive a charge from the braid of the cable in a region of said tubular member disposed externally to the electronic device, wherein said outer dimension defines at least one ridge, wherein said at least one ridge is configured to securely associate with at least one groove defined by a backshell of the electronic device, wherein said tubular member is configured so that said second opening is disposable within a device cavity defined by said backshell of the electronic device, wherein said portion of said end of the cable extends through said second opening into said device cavity; and wherein at least a portion of said outer dimension of said tubular member is configured to be enveloped by the braid, said portion being disposed externally to the electronic device, wherein said portion is configured such that said braid envelopes said portion without said braid being folded back upon itself or said portion.

2. The apparatus of claim 1, wherein said charge received from the braid of the cable creates a Faraday cage around said cable cavity that provides EMC shielding between the cable and the electronic device.

3. The apparatus of claim 1, wherein said tubular member comprises electromagnetic impulse conducting material.

4. The apparatus of claim 1, wherein said tubular member includes a first end and a second end, and at least one of said first end and said second end define a lip structure to facilitate secure associability of said tubular member with at least one of the electronic device and the cable.

5. The apparatus of claim 1, wherein said tubular member is configured to allow a portion of an end of the cable internal to the braid to be disposed within said cable cavity, said portion of said end of the cable being extendable through the cable cavity from said first opening through said second opening.

6. The apparatus of claim 1, wherein said at least a portion of said outer dimension of said tubular member is configured to be enveloped by the braid at 360 degrees.

7. A system for associating a cable with an electronic device and improving electromagnetic compatibility (EMC) shielding between the cable and the electronic device, the system comprising:

a tubular member including an outer dimension, and defining a first opening, a second opening, and a cable cavity, said tubular member being configured to associate with the electronic device; and a braid of the cable configured to envelop at least a portion of said outer dimension of said tubular member, wherein said portion is disposed externally to the electronic device, wherein said outer dimension is configured to receive a charge from said braid of the cable at least said portion, and wherein said portion is configured such that said braid envelopes said portion without said braid being folded back upon itself or said portion, wherein said outer dimension defines at least one ridge, wherein said at least one ridge is configured to securely associate with at least one groove defined by a backshell of the electronic device, wherein said tubular member is configured so that said second opening is disposable within a device cavity defined by said backshell of the electronic device, wherein said portion of said end of the cable extends through said second opening into said device cavity.

8. The system of claim 7, wherein said braid of the cable is configured to envelop said at least a portion of the outer dimension of the cable at 360 degrees.

* * * * *